United States Patent [19]

Meier

[11] 4,065,054

[45] Dec. 27, 1977

[54] CIRCULATING WATER HEATER

[75] Inventor: Hans Meier, Remscheid, Germany

[73] Assignee: Joh. Vaillant KG, Remscheid, Germany

[21] Appl. No.: 692,521

[22] Filed: June 3, 1976

[51] Int. Cl.[2] ..... F24D 3/08

[52] U.S. Cl. ..... 237/8 R; 237/19; 237/8 C

[58] Field of Search ..... 237/19, 8 R, 8 C, 8 D

[56] References Cited

U.S. PATENT DOCUMENTS

| | | | |
|---|---|---|---|
| 2,813,683 | 11/1957 | Dillman | 237/8 C |
| 3,544,005 | 12/1970 | Meier | 237/19 |
| 3,669,351 | 6/1972 | Meier et al. | 237/19 |
| 3,885,736 | 5/1975 | Amagani et al. | 237/19 |

FOREIGN PATENT DOCUMENTS

| | | | |
|---|---|---|---|
| 1,101,724 | 3/1961 | Germany | 237/8 C |
| 2,104,535 | 11/1971 | Germany | 237/19 |

*Primary Examiner*—William F. O'Dea
*Assistant Examiner*—Henry C. Yuen
*Attorney, Agent, or Firm*—Toren, McGeady and Stanger

[57] ABSTRACT

In a circulating water heater, a water heater is located in a flow circuit connected in parallel with a domestic water circuit. A heating circuit is connected in parallel with the domestic water circuit. A change-over valve interconnects the flow circuit containing the water heater with the domestic water circuit and the valve is also connected to the heating circuit. A short-circuit line including a pump interconnects the supply flow line and the return flow line in the flow circuit containing the water heater.

1 Claim, 1 Drawing Figure

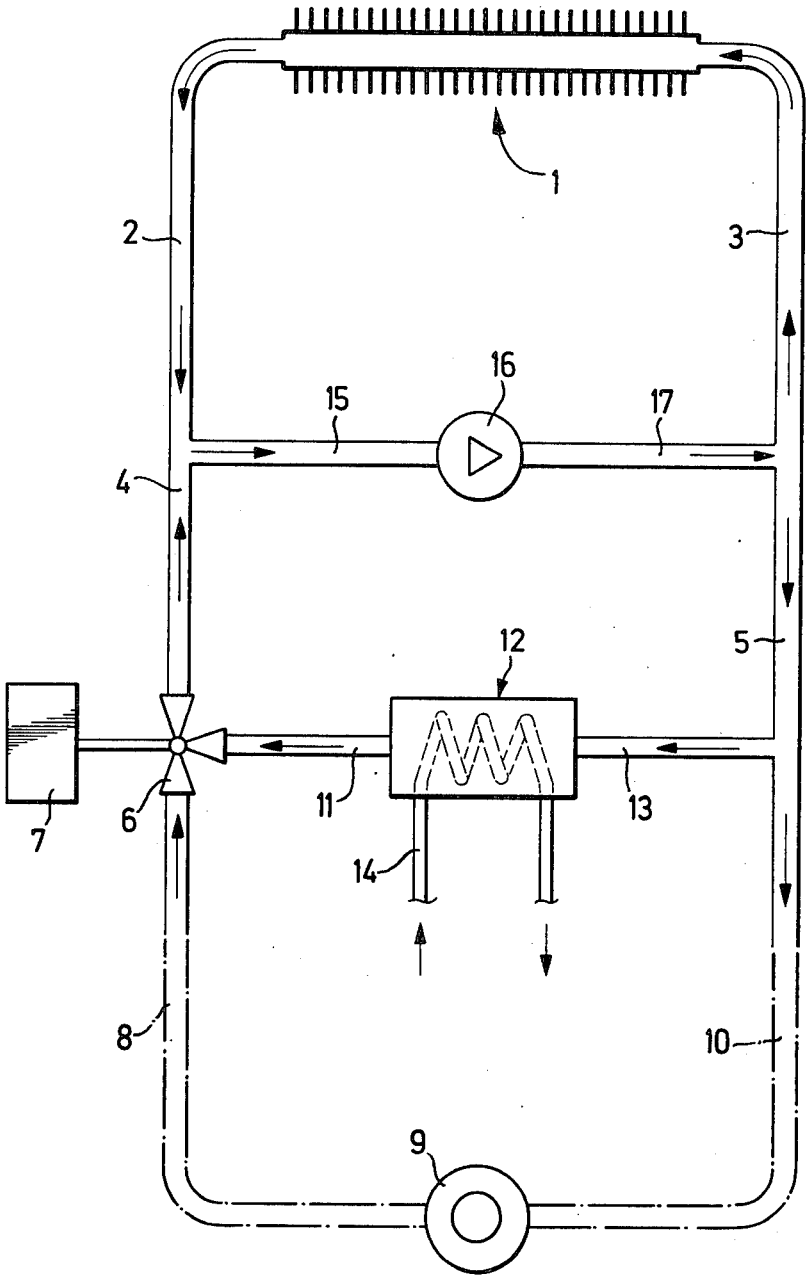
1
2
3
4
5
6
7
8
9
10
11
12
13
14
15
16
17

CIRCULATING WATER HEATER

This invention relates to a circulating water heater in accordance with the leading part of the main Patent Claim.

In such an arrangement known from the DT-AS 2 130 079 it is necessary for operating the heating system with connected domestic water heater to use two pumps which are arranged in the circuit of the heater, on the one hand, and in the heating circuit, on the other hand. As compared with this prior art it is the object of this invention to reduce the display of apparatus for the pumps.

From the DT-PS 12 53 890 it is prior art to connect a circulating water heater to a heating circuit via supply flow and return flow lines, a pump being provided in a short-circuit line parallel to the circulating water heater, respectively to the heating circuit. This prior art is disadvantageous in so far that domestic water heating is impossible.

It is an object of this invention — starting from the first-mentioned DT-AS 2 130 0 79 — to provide an arrangement which manages with one pump, while enabling a heating as well as a preparation of domestic water. At the same time, maintaining the currents in the heat exchangers of the heater and of the domestic water heater the pump capacity is to be minimized or the throughput through the heat exchanger is to be increased while keeping constant the pump capacity.

In a circulating water heater of the type hereinbefore described more closely this object is solved by the arrangement of the pump in a short-circuit line.

A relatively small system resistance is obtained whereby the requirements relative to the feed pressure of the pump are reduced. Therefore, it is possible to manage with a pump of substantially lower capacity, still the system obtains a greater efficiency.

An illustrative embodiment of the invention will be described hereinafter by reference to the accompanying drawing, in which there is shown a circuit diagram of an embodied form of the invention.

A gas water heater 1 — this could also be an electric water heater or a heater heated with oil — is connected to a supply flow line 2 and a return flow line 3. The supply flow line 2 is connected to a return flow line 4, , the return flow line 3 is connected to a supply flow line 5. The return flow line 4 is connected with a change-over valve 6 which is actuated by an adjusting mechanism 7. The change-over valve 6 has connected thereto a heating return flow line 8 of a plurality of heat exchangers 9, which, in turn, are supplied by a heating supply flow line 10 which is in connection with the supply flow line 5.

In parallel with to the heating circuit 8, 9 and 10 there is connected a domestic water circuit via a domestic water return flow line 11, a domestic water heat exchanger 12 and a domestic water supply flow line 13. The domestic water heater 12 has a cold water line 14 having a coil and a hot water tap valve not shown.

In parallel with to the gas water heater 1 including its supply flow line 2 and the return flow line 3 there is arranged a short-circuit line 15, 17 which interconnects the supply flow line 2 and the return flow line 3 with the interposition of a pump 16.

The arrangement hereinbefore described operates as follows:

When starting from the fact that the arrangement from cold condition shall be caused to assume operating temperature, provision is made by a thermostatic device not shown that the adjusting mechanism 7 of the change-over valve 6 prevents the possible entry of cold water from the heating circuit return flow line 8 and the domestic water return flow line 11 into the return flow line 4. When the gas water heater starts operating and the pump 16 is started, the latter can only suck water from the supply flow line 2 and the section 15 of the short-circuit line. The pump feeds the water through the second section of the short-circuit line 17 into the return flow line 3 from where it enters into the heat exchanger of the gas water heater and is heated in the latter. Hence, first the small circuit of the heater is heated very quickly, which contains a relatively small amount of water as compared with the water volume of the heating circuit or of the domestic water heating circuit. When the point of condensation temperature is exceeded, the adjusting mechanism 7 opens the change-over valve 6 and connects either the domestic water return flow line 11 or the heating return flow line 8 to the return flow line 4. The first position of the valve is assumed when domestic water is tapped. This can be accomplished by a differential pressure switch via the cold water line 14. The heater circuit is then in parallel connection with the domestic water heating circuit comprised of the lines 5, 13, 12, 11 and 4. When heat is needed from the heating circuit 8, 9 and 10, for instance, via a room thermostat not shown, the adjusting mechanism 7 of the change-over valve provides for a control — if necessary partially — of the heating circuit so that either the heating circuit 8, 9 and 10 is in parallel connection with the heater circuit or that both the domestic water heating circuit and also the heating circuit are in parallel connection with the heater circuit.

I claim:

1. A circulating water heater comprising a water heater, a first supply flow line having a first end connected to said water heater and a second end spaced therefrom for conducting flow from said water heater, a first return flow line having a first end connected to said water heater and a second end spaced therefrom for returning flow to said water heater, a pipe circuit interconnecting the second ends of said first supply flow line and said first return flow line and having a first end connected to said first supply flow line and a second end connected to said first return flow line, a short-circuit line having a first end and a second end with the first end thereof connecting the junction of the second end of said first supply flow line and the first end of said pipe circuit and the second end thereof connecting the junction of the second end of said first return flow line and the second end of said pipe circuit for conveying flow of water from the first end to the second end thereof, a domestic water heater located in said pipe circuit, said pipe circuit comprising a domestic water return flow line having a first end and a second end with said first end connected to said domestic water heater, a selectively adjustable change-over valve connected to the second end of said domestic water return flow line, a second return flow line having a first end and a second end with the first end thereof connected to said change-over valve for receiving flow from said domestic water return flow line and with the second end thereof connected to the second end of said first supply flow line and to the first end of said by-pass line, a domestic water supply flow line having a first end and a second end, the first end thereof connected tosaid domestic water heater, a second supply flow line having a first end and a second end with the first end thereof connected to the second end of said domestic water supply flow line and the second end thereof connected to the second end of said first return flow line and to the second end of said short-circuit line, wherein the improvement comprises a pump located in said short-circuit line between the first and second ends thereof, at least one heat exchanger a third return flow line having a first end and a second end with the first end thereof connected to said heat exchanger and the second end thereof connected to said change-over valve, and a third supply flow line having a first end and a second end with the first end thereof connected to said heat exchanger and the second end thereof connected to the second end of said domestic water supply flow line and to the first end of said second supply flow line whereby in the cold condition with said change-over valve closed preventing flow from said domestic water return flow line and from said third return flow line into said second return flow line, flow from said water heater can be circulated through said first supply flow line, said short circuit line and said first return flow line back into said water heater and when the point of condensation temperature is exceeded, said change-over valve can be opened for connecting at least one of said domestic water return flow line and said third return flow line to said second return flow line thereby increasing the flow through said short-circuit line and through said pump therein.

* * * * *

UNITED STATES PATENT OFFICE

CERTIFICATE OF CORRECTION

Patent No. 4065054 Dated December 27, 1977

Inventor(s) Hans Meier

It is certified that error appears in the above-identified patent and that said Letters Patent are hereby corrected as shown below:

In the heading of the patent [75] should read as follows.

-- [75] Inventor: Hans Meier
An der Kirche 6
D-5828 Ennepetal-Voerde, Germany--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*